US007111652B2

(12) United States Patent
Koide et al.

(10) Patent No.: US 7,111,652 B2
(45) Date of Patent: Sep. 26, 2006

(54) MIXED LIQUID MANUFACTURING APPARATUS

(75) Inventors: Akira Koide, Azuma (JP); Ryo Miyake, Tsukuba (JP); Yasuo Ito, Ami (JP); Yoshishige Endo, Tsuchiura (JP)

(73) Assignee: Hitachi Industries Co., Ltd., Tokyo (JP)

( * ) Notice: Subject to any disclaimer, the term of this patent is extended or adjusted under 35 U.S.C. 154(b) by 190 days.

(21) Appl. No.: 10/855,431

(22) Filed: May 28, 2004

(65) Prior Publication Data

US 2005/0087562 A1 Apr. 28, 2005

(30) Foreign Application Priority Data

Oct. 8, 2003 (JP) ..... 2003-348955

(51) Int. Cl.
*B65B 1/04* (2006.01)

(52) U.S. Cl. ..... 141/104; 141/94

(58) Field of Classification Search ..... 141/2, 141/18, 9, 100, 104, 94
See application file for complete search history.

(56) References Cited

U.S. PATENT DOCUMENTS 5,348,061 A * 9/1994 Riley et al. ..... 141/104
5,493,840 A * 2/1996 Cane ..... 53/50
5,544,684 A * 8/1996 Robinette, III ..... 141/83
6,247,507 B1 * 6/2001 Soehnlen et al. ..... 141/2

FOREIGN PATENT DOCUMENTS

| | | |
|---|---|---|
| JP | 05-216900 | 8/1993 |
| JP | 10-083421 | 3/1998 |
| JP | 2001-126140 | 5/2001 |
| JP | 2002-284618 | 10/2002 |

* cited by examiner

*Primary Examiner*—Steven O. Douglas
(74) *Attorney, Agent, or Firm*—Antonelli, Terry, Stout and Kraus, LLP.

(57) ABSTRACT

A mixed liquid manufacturing apparatus comprises: an information input unit, in which information of an object, to which a mixed liquid is offered, is input; a material storage system that stores a plurality of materials for a mixed liquid; a product information system that selects kinds and quantities of the stored materials on the basis of the input information of the object, to which a mixed liquid is offered; a liquid transfer unit, by which the selected materials are taken out from the material storage system; a mixing unit, in which the materials supplied from the liquid transfer unit are mixed; an injection unit, by which the mixed liquid is injected into a mixed liquid container; an input unit, by which matters being declared on a label of the mixed liquid container are input; and a label formation unit, in which the input matters are printed on the label and the label is stuck on the mixed liquid container, and wherein the label formation unit begins printing before the injection unit completes injection of the mixed liquid into the container.

11 Claims, 8 Drawing Sheets

FIG.6A
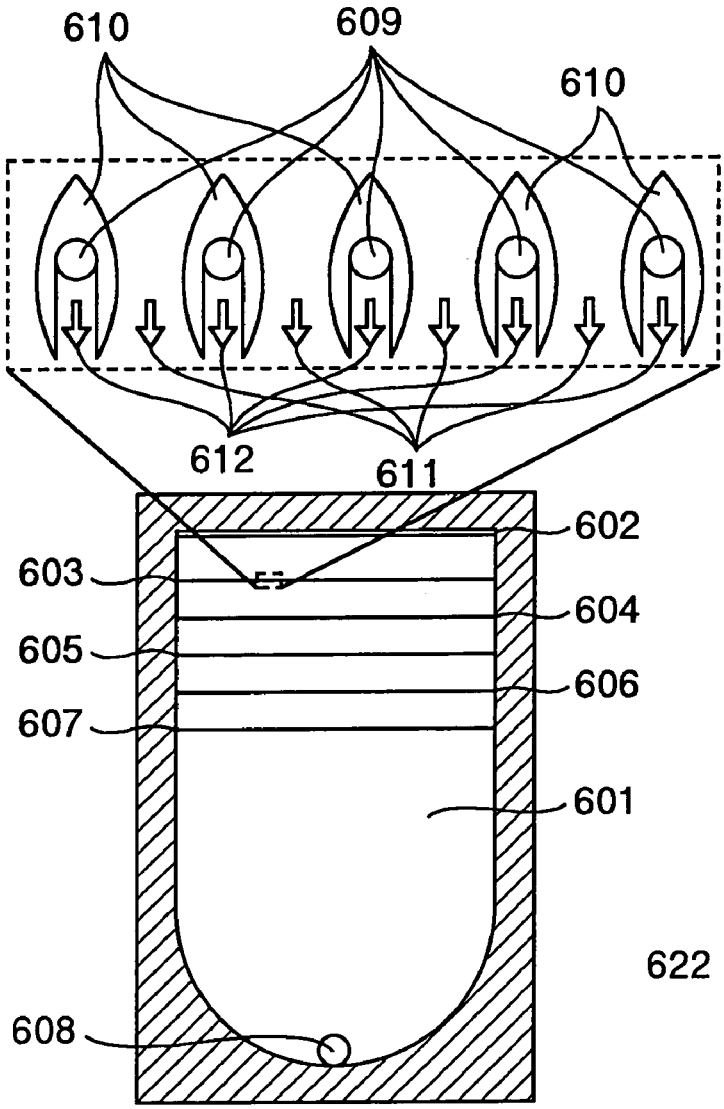
FIG.6C
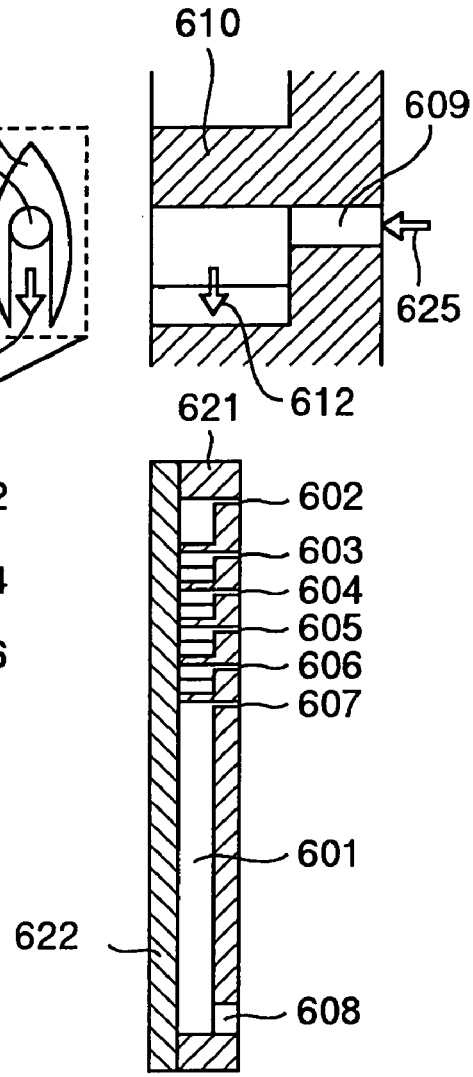
FIG.6B

MIXED LIQUID MANUFACTURING APPARATUS

BACKGROUND OF THE INVENTION

The present invention relates to a mixed liquid manufacturing apparatus.

Recently, products made to partial order and conformed to an individual's taste and physical constitution are increased among shampoo, toothpaste, perfume, etc. Incidentally, amendment of the Pharmaceutical Affairs Law in 2001 with respect to, for example, cosmetic annuls the registration system every product, and allows freely changing a component ratio of registered materials as far as the materials are used in the range of allowed rates, so that there is opened up a road to cosmetic made to order, by which cosmetic conformed to a customer's taste and physical constitution are offered. In keeping with this, counseling cosmetic meeting carefully with a customer's need by increasing the number of goods and combining the goods with counseling begin to account for much on the market. However, this is responsible for an increase in cost because respective shops must posses various kinds of cosmetics in stock. As measures to carry this a step further, JP-A-5-216900 and JP-A-10-83421 propose a cosmetic ordering production control system, in which after attending to demand of a customer, such information is forwarded to a factory, and a desired cosmetic is manufactured and forwarded to the customer.

JP-A-2001-126140 proposes the provision of a cosmetic factory (clean room) in juxtaposition with a cosmetics shop in order to manufacture and sell a cosmetic meeting with a customer's demand.

JP-A-2002-284618 discloses a configuration, in which a compounding device placed in a clean bench is used to dispense necessary materials in necessary quantities into a sales container and to dispense and sell perfume at need.

However, with the measures disclosed in JP-A-5-216900 and JP-A-10-83421, it takes several days for a customer to get cosmetic, and it cannot be said that the measures adequately meet with the customer's demand that the cosmetic is in immediate need.

In the configuration disclosed in JP-A-2001-126140, color, scent, and a feeling of quality, which are conformed to a customer's demand, are given to a material (semi-product) that constitutes a base of cosmetic, in the juxtaposed factory. Since a semi-product is used as a material, production in a small factory becomes possible and what is desired by a customer can be offered on the spot. However, since a clean room maintained in a sanitary condition must be provided in juxtaposition with a shop, a device becomes large in size and an initial cost and a running cost are increased. Also, it cannot be said that the configuration adequately meets with a customer's demand that the cosmetic is in immediate need.

In the configuration disclosed in JP-A-2002-284618, there is no need of the cost of installation and an equipment that needs maintenance expenses, and it is possible to manufacture and sell cosmetic at low cost on the spot.

In the device disclosed in JP-A-2002-284618, however, raw liquids metered and fed via pumps from respective material containers are sequentially discharged into sales containers from nozzles to form cosmetic. However, it cannot be said that the device adequately meets with a customer's demand that the cosmetic is in immediate need.

Dispensing from the nozzles is performed every raw liquid, but the cut off performance of the liquid at the nozzles at the time of dispensing must be maintained in the same condition for "any raw liquid" and "discharge for any time of dispensing" in order that cosmetic should be kept in quality (component structure ratio, uniformity, sanitary aspect, etc.). However, the cut off performance of the liquid from the nozzles depends upon viscosity and surface tension of an associated liquid, which depend upon components and temperature of the liquid.

Further, when discharged from the same nozzle, there is caused a problem that liquid adhering to a nozzle portion dries to thereby change the cut off performance of the liquid at the nozzle portion and varies in the quantity of the liquid adhering to the nozzle portion. Furthermore, since uniform mixing of liquids cannot be achieved only by discharging the liquids into a sales container from nozzles, cosmetic of good quality cannot be offered to a customer unless agitation is carried out after all raw liquids are put into the sales container.

BRIEF SUMMARY OF THE INVENTION

The invention provides a mixed liquid manufacturing apparatus capable of solving at least one of the problems described above.

A mixed liquid manufacturing apparatus according to the invention can solve one of the problems described above.

Thereby, even if being an on-demand manufacture apparatus, an apparatus capable of quickly offering a product to an object, such as a customer, to which a mixed liquid is offered.

Further, it is possible to provide a manufacture/selling system, in which deterioration in quality is suppressed and a mixed liquid made to order is offered at low cost to a customer.

According to the invention, a flow-treatment type micro fluid device is used as means that uniformly mixes a plurality of minute liquids with good reproducibility without relying on the volume of production. When raw liquids are metered and mixed together, the respective raw liquids are not separately dispensed into a sales container but the respective raw liquids are introduced into a single micro fluid device at a time to pass therethrough and dispensed into a sales container as a final product whereby even minute quantities are always mixed into a stable component structure and offered as a final product. In view of the fact that uniform mixing of liquids is effected by diffusion of components of respective raw liquids, the micro fluid device used in mixing of the respective raw liquids has measures to shorten diffusion time, during which liquids completely mix together. Concretely, the measures comprise the function of enlarging ratios of areas of interfaces between liquids and the function of shortening distances, in which the components diffuse into one another. Thereby, only pass through such micro fluid device realizes homogeneous mixing of liquids and dissolves the problem of liquid cut off at nozzles at the time of dispensing and the problem of uniform mixing.

The invention provides a mixed liquid manufacturing apparatus comprising: an information input unit, in which information of an object, to which a mixed liquid is offered, is input; a material storage system that stores a plurality of materials for a mixed liquid; a product information system that selects kinds and quantities of the stored materials on the basis of the information of an object, to which a mixed liquid is offered, as input; a liquid transfer unit, by which the selected materials are taken out from the material storage system; a mixing unit, in which the materials supplied from the liquid transfer unit are mixed; an injection unit, by which the mixed liquid is injected into a mixed liquid container as installed; an input unit, by which matters being declared on a label of the mixed liquid container are input; and a label formation unit, in which the matters as input are printed on the label and the label is stuck on the mixed liquid container; and wherein printing is begun before injection of the mixed liquid at the injection unit is completed.

A mixed liquid conformed to a need can be offered without making an object (for example, a customer), to which a mixed liquid such as cosmetic liquid, perfume, etc, is to be offered, have a feeling of wait. By performing the process of label formation in the process of manufacture of a mixed liquid, it is possible to draw an attention of an object, to which a mixed liquid is to be offered, to reduce a substantial waiting time, thus enabling offering a tailor-made mixed liquid at high speed.

Alternatively, the invention provides a mixed liquid manufacturing apparatus comprising: an information input unit, in which customer information is input; a material storage system that stores a plurality of materials for a mixed liquid; a product information system that selects kinds and quantities of the stored materials on the basis of the customer information; a liquid transfer unit, by which the selected materials are taken out from the material storage system; a mixing unit, in which the materials supplied from the liquid transfer unit are mixed; an injection unit, by which the mixed liquid is injected into a mixed liquid container as installed; an input unit, by which matters being declared on a label of the mixed liquid container are input; and a label formation unit, in which the matters as input are printed on the label and the label is stuck on the mixed liquid container.

The mixed liquid manufacturing apparatus can comprise the mixing unit having the following construction.

The mixing unit comprises a first substrate and a second substrate that defines a first flow passage, through which a first fluid flows, between it and the first substrate, wherein the first substrate comprises a first nozzle region and a second nozzle region, through which a second fluid being mixed with the first fluid flowing through the first flow passage flows, and the first nozzle region and the second nozzle region are arranged to interpose therebetween the first flow passage.

Since the mixing nozzles are formed on a side of the first substrate, a multiplicity of minute nozzles can be easily formed.

In addition, it is preferable that the first nozzle region comprises a multiplicity of first nozzles arranged on a first wall, which is formed on the first substrate, along a flow direction in the first flow passage, and a supply unit for the first mixed fluid being supplied to the first nozzles is formed to be positioned relative to the first flow passage with the first wall therebetween.

Likewise, it is preferable that the second nozzle region comprises a multiplicity of nozzles arranged on a second wall, which is formed on the second substrate, along a flow direction in the first flow passage, and a supply unit for the second mixed fluid being supplied from the second nozzles is formed to be positioned relative to the first flow passage with the second wall therebetween.

Alternatively, the mixing unit comprises a first substrate and a second substrate that defines a first flow passage, through which a first fluid flows, between it and the first substrate. The first substrate comprises a first nozzle region, in which a plurality of first nozzles for supplying a first fluid being mixed with the fluid flowing through the first flow passage are arranged at intervals in a direction transverse to the flow of the first fluid, and a second nozzle region, which is disposed on a downstream side of the first flow passages in the first nozzle region, and in which a plurality of second nozzles for supplying a second mixed fluid being mixed with the fluid flowing through the first flow passages are arranged at intervals in the direction transverse to the flow of the first fluid. The second nozzles are arranged in a region, through which the first mixed fluid supplied by the first nozzles flows, among a region, through which the first fluid flows.

Further, these configurations have a feature in that the first mixed fluid supplied from the first nozzle region is larger in flow rate than that of the second mixed fluid that is supplied from the second nozzle region and is smaller in dispensing quantity than the first mixed fluid.

Further, it is preferable in constructing an on-demand manufacture/selling system that a sample liquid having the same quality as a final product and having a minute quantity be fabricated before the final product is manufactured, and the final product is manufactured after the final confirmation by a customer.

Further, it is preferable that a region extending from material packs to a dispensing system be constructed by a closed system that does not come into contact with an external world.

Further, in the case where materials are high in viscosity, a temperature regulating system is provided for the liquid transfer unit, the mixing unit, and the dispensing unit. It is preferable that there be provided a temperature regulating system that maintains temperatures at ones, at which the materials are small in viscosity, and restricts pressure loss caused by flowing of liquids to an allowable range of the system.

Further, in constructing an on-demand manufacture/selling system having a feature in that a salesman operates the system in accordance with a customer's demand, it is preferable that the system be sized to be able to be accommodated in a space such as one on a desk, or a half mat. Alternatively, it is preferable that the system be sized and weigh to be portable such that a salesman visits a customer to be able to operate the system in accordance with a customer's demand.

Further, it is preferable that the mixing unit be one provided with a micro fluid device and formed by applying the micromachining technique that is based on the photolithography technique for semiconductors, on materials, such as resin and metal, selected every use.

In addition, while the mixed liquid is preferably perfume or cosmetic liquid, other mixed liquids can be used in manufacture.

It is possible according to the invention to provide a mixed liquid manufacturing apparatus that can solve at least one of the problems described above.

Therefore, it is possible to provide a mixed liquid manufacturing apparatus that can quickly supply a mixed liquid corresponding to an object, to which the mixed liquid is to be offered.

Other objects, features and advantages of the invention will become apparent from the following description of the embodiments of the invention taken in conjunction with the accompanying drawings.

BRIEF DESCRIPTION OF THE SEVERAL VIEWS OF THE DRAWING

FIGS. 4A and 4B are views illustrating a flow state in the first embodiment of the micro fluid device shown in FIG. 3, in which FIG. 4A is a vertical cross sectional view and FIG. 4B is a horizontal cross sectional view.

FIGS. 5A and 5B are views showing an outline of a second embodiment of the micro fluid device according to the invention, in which FIG. 5A is a horizontal cross sectional view and FIG. 5B is a vertical cross sectional view.

FIGS. 6A, 6B and 6C are views showing an outline of a modification of the micro fluid device shown in FIGS. 5A and 5B, in which FIG. 6A is a horizontal sectional view, FIG. 6B is a vertical cross sectional view and FIG. 6C is a vertical cross sectional view of a nozzle.

DETAILED DESCRIPTION OF THE INVENTION

One of embodiments included in the invention will be described hereinafter. The invention is neither limited to a configuration disclosed in the following embodiments nor precludes a modification based on a well-known art.

Figure 1:
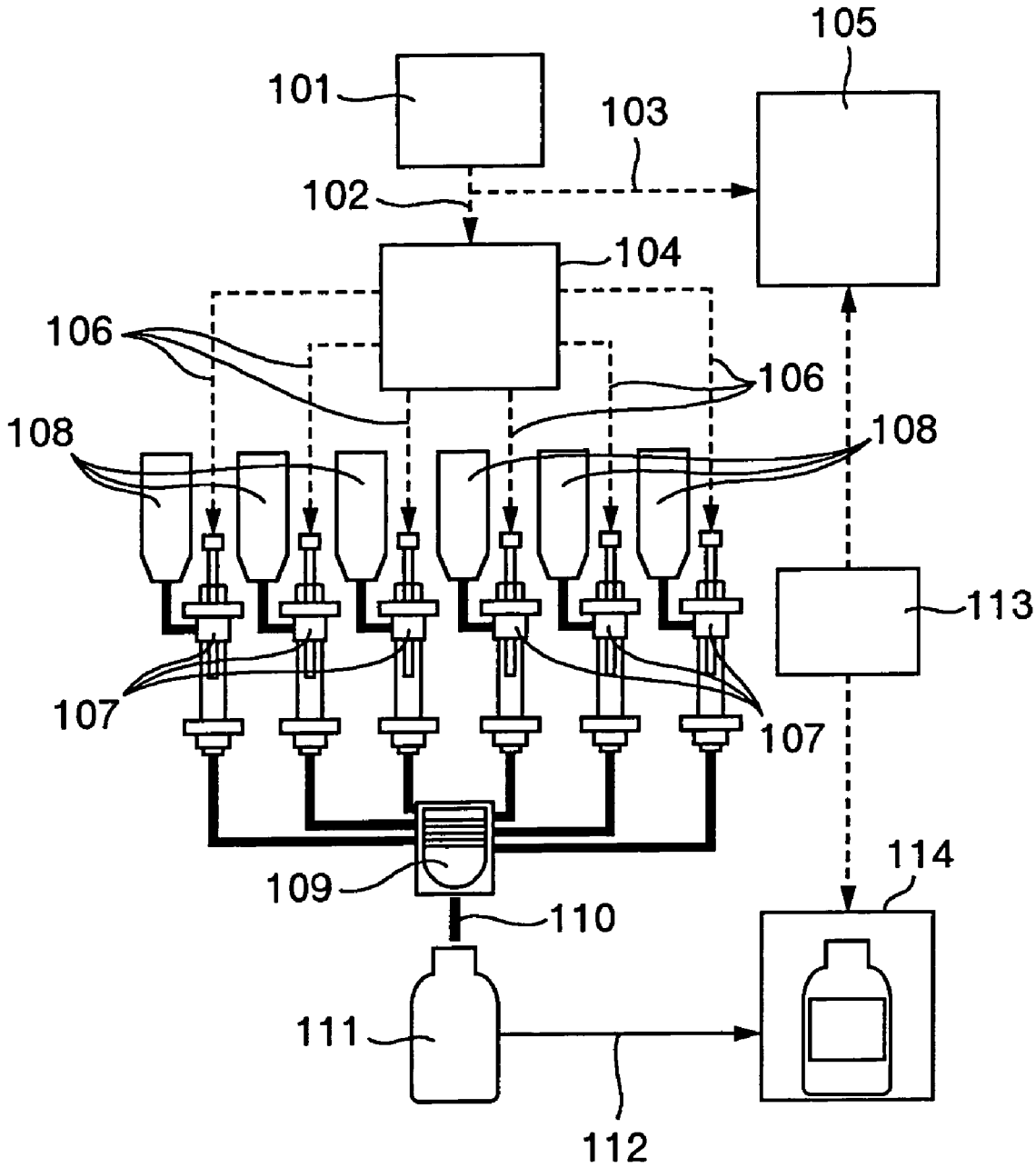
FIG. 1 is a view showing an outline of an embodiment of a mixed liquid manufacturing apparatus according to the invention.

FIG. 1 shows an on-demand manufacture/selling system for cosmetic as a mixed liquid manufacturing apparatus according to a first embodiment of the invention. In manufacture/selling of those products of various kinds and small quantities, which are desirably different depending upon taste and physical constitution every individual, it is possible in a store front to manufacture and offer a product having a component structure conformed to a customer's need. Thereby, it is possible to construct an on-demand manufacture/selling system.

It is preferable that such system has, for example, the following construction:

1) a customer information system that acquires customer information for determination of an optimum component structure for a customer and retrieves customer information;
2) a product information system that determines an optimum product component structure for a customer on the basis of customer information;
3) a material storage system that individually stores two or more kinds of materials required for creation of a product;
4) a liquid transfer system that selects materials on the basis of information from the product information system and portions out the materials from the material storage system to have the same flowing;
5) a micro fluid device that causes respective materials fed from the liquid transfer system to pass therethrough simultaneously;
6) a dispensing system that puts a product leaving the micro fluid device in a container; and
7) a cleaning system that maintains cleanliness in respective processes.

Manufacture and sale of a product are performed such that information is first collected in a customer information system 101 that examines customer's skin nature and taste, information obtained in the system is forwarded (102) to a product information database 104, and a component structure of an optimum product for a customer is derived. At this time, the customer information system 101 also forwards (103) information to a customer information database 105 to accumulate therein the same as customer information. The component structure of a product derived from the product information database 104 is forwarded (106) to respective liquid pumps 107 that meter respective materials and feed the same, and necessary quantities of respective components are taken out from material pack management systems 108 and simultaneously fed to a mixing device (a micro fluid device 109 is used as an example in this embodiment) for respective selected materials at flow rates that are conformed to respective flow ratios. The respective materials having been fed to the micro fluid device 109 pass through an interior of the micro fluid device, and is forwarded to a dispensing nozzle 110 to be dispensed to a product container 111. While the product is fabricated, an associated customer thinks a pattern of a label being stuck on the container 111 that contains the customer's product, and a product name to input the same into a system 113. Data as input are forwarded to a label printing/sticking device 114, the container 111, to which a product has been dispensed by the micro fluid device 109, is conveyed, a label is stuck on the container, and the container is offered as a product to the customer. Hereupon, since the use of the micro fluid device 109 allows all the components to be dispensed together and only passing through the micro fluid device 109 terminates uniform mixing and agitation is not needed, packing of the product in the container 111 is completed in several minutes, so that when printing information for a label has been input, printing is immediately performed on the label, and the label is stuck on the container 111, thus enabling offering the container to the customer. Thereby, the customer can get the product immediately after completion of inputting of the information and so is relieved of stress that would be generated by waiting.

In particular, it is preferred that the on-demand manufacture/selling system for cosmetic comprises: an information input unit, into which customer information is input; a material storage system that stores a plurality of materials for a mixed liquid; a product information system that selects kinds and quantities of the stored materials on the basis of the customer information as input; a liquid transfer unit, by which the selected materials are taken out from the material storage system; a mixing unit, in which the materials supplied by the liquid transfer unit are mixed; an injection unit, by which the mixed liquid is injected into a cosmetic liquid container as installed; an input unit, by which matters being declared on a label of the mixed liquid container are input; and a label formation unit, in which the matters as input are printed on the label and the label is stuck on the mixed liquid container, and printing in the printing unit is begun before injection of the mixed liquid at the injection unit is completed.

By constructing the system in this manner, a mixed liquid conformed to a need can be offered without making an object (for example, a customer), to which a mixed liquid such as cosmetic liquid, perfume, etc, is to be offered, have a feeling of wait.

By performing the process of label formation in the process of manufacture of a mixed liquid, it is possible to draw an attention of an object, to which a mixed liquid is to be offered, to reduce a substantial waiting time, thus enabling offering a tailor-made mixed liquid at high speed.

The system can include a cap formation unit that caps a container containing the mixed liquid, such as cosmetic liquid, as injected. In this case, printing in the printing unit is controlled so that it is begun before cap formation in the cap formation unit is completed.

The customer information system includes, for example, database indicative of the relationship between input customer information (information (preferably, at least one of moisture, sebum, elasticity, pH, skin picture information, etc.) detected by sensors with respect to a product offer object) and quantities of at least main material components, or database, in which calculating formulae therefor are accumulated. Further, the system includes a selection mechanism, by which component quantities constituting cosmetic or the like are selected on the basis of such database.

Details of respective processes will be described hereinafter.

In the customer information system 101, a computer or a counselor asks a customer questions and the customer answers the questions, whereby the customer's taste is known, the customer's physical constitution is guessed, and they are input into the system. As measures for acquiring detailed customer information, there is a method, in which a counselor examines a customer's skin nature by performing palpation and using various sensors (for example, moisture meter, sebum meter, elasticity meter, pH meter, skin picture, Wood's lamp), and inputs the skin nature into the system.

Information obtained in the customer information system 101 is delivered to the product information database 104,and a component structure of cosmetic assumed to be optimum for the customer is presented. Further, the information as obtained is simultaneously registered as the customer' private information in the customer information database 105. Here, obtained from the registered information is information such as seasonal variation in skin nature, degree of improvement, or the like from historical data of the registered information of skin nature in the case where the customer becomes a repeater, so that it becomes possible to present a careful proposal to the customer. Also, by aggregating data, from which customer's names are removed, it becomes possible to build database of differences in skin nature for regions and age and to produce new information for product development and sales strategy to make merchandise of the information itself.

Component structure data of a product optimum for the customer, derived from the product information database 104 are forwarded (106) to control systems of the liquid pumps 107 communicated to the respective material pack management systems 108, and only necessary quantities of respective materials are simultaneously introduced into the liquid pumps 107 from the material pack management systems 108, and forwarded to the micro fluid device 109 from the respective liquid pumps 107 at flow rates that are conformed to respective quantities of respective components. FIG. 1 exemplarily shows the case where a product is manufactured from six kinds of materials. The respective material pack management systems 108 are ones that perform management in a manner to prevent entry of impurities (bacillus, dust, etc.) and generation of quality degradation due to contact with outside air and temperature rise. Material packs are supplied to cosmetic dealers in a state of hygienic airtight sealing and mounted on the material pack management systems 108 in use.

At this time, needle-type nozzles communicated to the liquid pumps 107 enter into the material packs, so that materials and the liquid pumps 107 are first connected to each other. Needle-type nozzle inserts of the material packs mount thereon rubber plugs or airtight film whereby even when the nozzles are inserted, they come into close contact with the rubber plugs or airtight film to eliminate contact, at associate portions, of materials with outside air. Further, since some materials degrade when coming into contact with air, it is not desired that a space is produced within a material pack when a material in the material pack is used, in which case a material pack is made of flexible sheet to be deformed with consumption of a material and decreased in volume. Thereby, a material gets off without coming into contact with outside air and can be maintained in quality over a long term.

Figure 2:
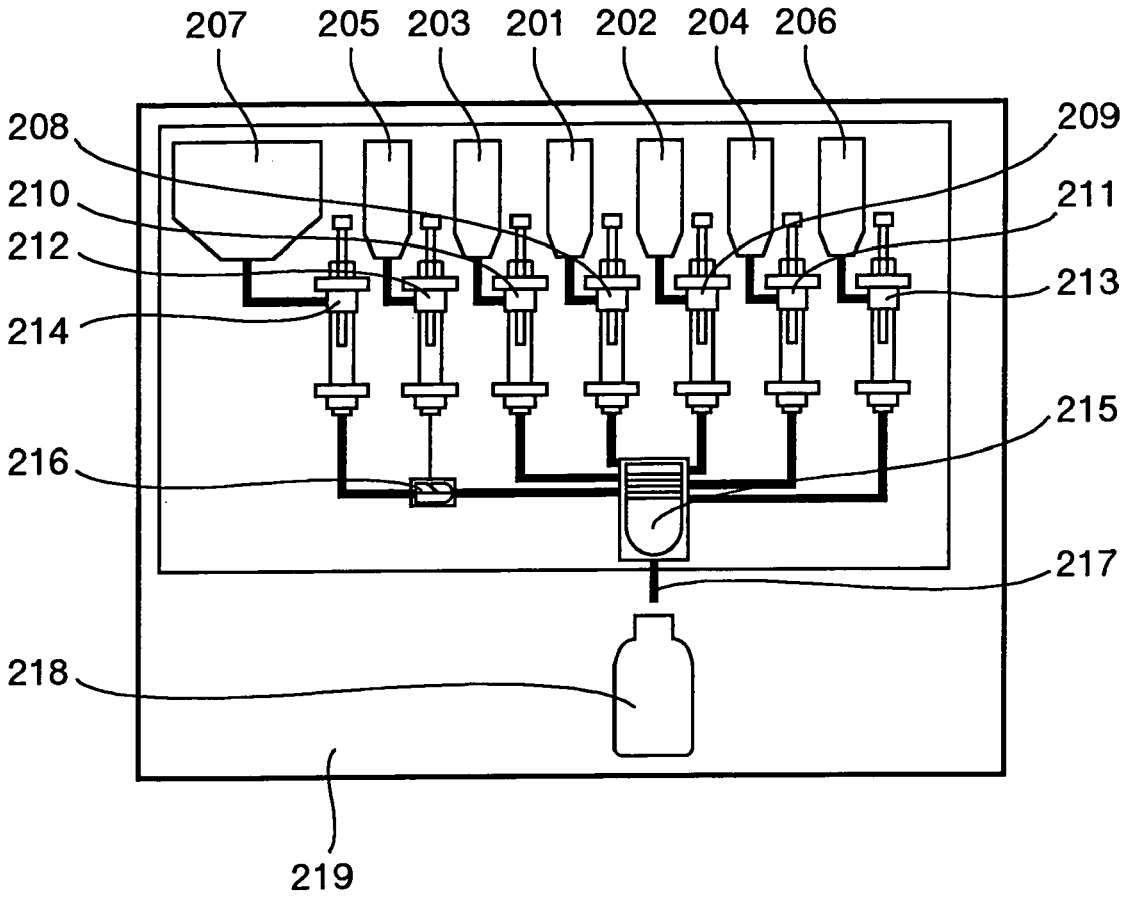
FIG. 2 is a view showing an outline of a modification of the embodiment of the mixed liquid manufacturing apparatus according to the invention.

Further, in the case where a sheet that contains therein a material is too soft and difficult to maintain its shape independently, it is combined with an outer container made of a resin having rigidity to be made a combination pack. A material loaded in a bag made of a thin sheet is received in the outer container and mounted together with the outer container, and the soft sheet disposed inside is deformed and decreased in volume as the material is consumed. Thereby, the material can be maintained in quality over a long term without contact with outside air until it is exhausted. In addition, in the case where a material has a nature to go bad even without contact with an air, the material pack management systems 108 are endowed with a temperature adjusting function to keep the material at low temperatures to maintain the same in quality over a long term. In the case where the material pack management systems 108 are endowed with the temperature adjusting function, an electric current is carried to the material pack management systems 108 even when an electric source of an on-demand manufacture/selling system is put off. Further, fundamental components, such as purified water and glycerol, among various materials that constitute cosmetic account for a major part of component ratio, and various materials are mixed therewith according to functions needed except those of the fundamental components. Accordingly, it is desired that material packs be changed in size according to ratios of use depending upon kinds of materials. Further, in the case where a liquid being mixed is very small in quantity in the order of several % or less of purified water and glycerol that constitute main liquids, a method is conceivable, in which correct mixing of even a trace liquid is stably realized by using a pretreatment micro fluid device 216 shown in FIG. 2 to beforehand mix a main material fed from a material management system 207 that contains purified water or glycerol, with the use of a liquid pump 214 and a minor component fed from a material management system 205 of a minor component with the use of a liquid pump 212, and feeding the mixture to a micro fluid device 215 together with other components. Alternatively, a method is conceivable, in which a minor liquid having been beforehand mixed with a main liquid is contained in a material pack instead of mixing in the device.

The liquid pumps 107 shown in FIG. 1 take out respective materials of required quantities from the material pack management systems 108 to feed the same to the micro fluid device 109. Since respective materials must be fed while being metered, syringe pumps are optimum as the liquid pumps. Further, as described with respect to the material packs, materials are much different in quantity being fed, and so it is desired that syringe pumps be respectively set in capacity according to ranges of material quantity being fed.

An example of the feeding procedure in the case of using syringe pumps is described as follows.

1) Set all syringe pumps in positions, in which inner volumes thereof are minimum.
2) Insert needle-type nozzles into all material packs and connect the nozzles to respective material syringe pumps.
3) Drive the syringe pumps in a direction, in which inner volumes of the respective syringe pumps are increased, and suck respective materials are sucked from the respective material packs.
4) Drive the syringe pumps in a direction, in which inner volumes thereof are decreased, when inner volumes of the respective syringe pumps reach suitable quantities.
5) Repeat the operations 3) and 4) until the respective syringe pumps 107 and respective pipes between the respective material pack management systems 108 and the micro fluid device 109 are filled with respective material liquids.
6) When the operations up to 5) have been completed for all the materials, drive the syringe pumps 107 in a manner to introduce respective material liquids into the respective syringe pumps 107 connected to those material pack management systems 108, which are required according to a component ratio of a finished product.
7) Feed respective materials all at once to the micro fluid device 109 from the syringe pumps 107 at flow ratios conformed to the component ratio of a finished product.

Further, the respective syringe pumps are controlled in a manner to make a flow rate (a supply flow rate per unit time) of a first mixed material larger than a flow rate of a second mixed material that is smaller in dispensed quantity than the first mixed material. Thereby, it is possible to reduce differences in supply times of respective components into a first flow passage, in which respective component materials flow in a mixed state, to obtain a favorable mixed state. It is preferable to adjust flow rates of discharge into the mixing regions according to respective dispensing ratios. More preferably, control is performed in a manner to provide for the same supply time within the range of control error.

At this time, it is desired that quantities fed until flow within the micro fluid device 109 becomes stable be not dispensed but discarded. Further, it is desired that material liquids handled by the respective syringe pumps 107 be the same in principle. However, in the case of changing kinds of materials handled by the respective syringe pumps 107 so as to carefully accommodate a customer's taste, and not operating the device over a long term, portions of the on-demand manufacture/selling system, which are brought into contact with materials, are washed. In this case, there are assumed methods of removing material packs from the material pack management systems 108 and mounting wash liquid packs instead; preparing wash liquid packs separate from material packs and performing washing by means of the same feeding means as that in manufacture of a finished product; and separately providing a wash system that use purified water, etc. While a system of recovering and discarding a wash liquid is necessary in all the methods, the micro fluid device 109 has a feature in a small dead volume, so that it is possible to restrict quantities of waste liquids to small and it suffices that a waste liquid tank be recovered at the end of a day. In some methods, in which liquid pumps except syringe pumps are used, material packs themselves can be used as displacement pumps. This is realized by adding to the material pack management systems 108 means for reducing a volume of that portion of a material pack, in which a material is received. For example, there is a method, in which a structure serving as a piston is provided in an upper portion of a material pack and a material in the material pack is pressed out by pushing the piston. In another method, a material pack itself is squashed in the case where the material pack is soft. In this case, the material pack management systems 108 are required to have a frame structure that prevents a material pack from being pressingly extended toward an outer periphery thereof. Further, a system making use of tube pumps as inexpensive liquid pumps 107 is conceivable. Since such pumps are not suited to feeding of liquids of very small quantities, however, there is a need of before-hand diluting the liquids of very small quantities with purified water, glycerol, etc. in the case where some components having component ratios of several % or less are present in material liquids. In addition, there is a method of raising temperatures of portions, through which materials pass, to ones, at which the materials are decreased in viscosity, in the case where liquids having high viscosities are handled as the materials. Thereby, it becomes possible to use the on-demand manufacture/selling system to form cream making use of materials that are high in viscosity.

It is desired that the micro fluid device 109, 215 used in the on-demand manufacture/selling system be easily mounted on and dismounted from the on-demand manufacture/selling system and an optimum micro fluid device 109, 215 be mounted according to a product being formed. In order to perform mounting and dismounting of the micro fluid device, it is necessary to achieve fluid connection of the same to the liquid pumps 107, 208–214 and the dispensing nozzle 110, 217 in a leakage-free manner, so that a joint is desirably incorporated into the micro fluid device 109, 215. There is conceivable, for example, a method, in which a piece of rubber or airtight film is mounted at inlets of respective materials in the micro fluid device 109, 215 and the liquid pumps 107, 208–214 are connected to the micro fluid device by inserting needle-type nozzles provided at distal ends of the liquid pumps into the micro fluid device. In another mounting and dismounting method, sealing materials are inserted into and pushed against those portions, which connect the liquid pumps 107, 208–214, the dispensing nozzles 110, 217, and the micro fluid device 109, 215 to one another. In either of the methods, it is necessary to apply the water repellent treatment so as to prevent material liquids from adhering to the mount and dismount portions, or to wash the mount and dismount portions, such as nozzles, sealing materials, etc. at the time of exchange. There is conceivable a washing method, in which adhered liquids are removed with the use of an air and a liquid absorbing material such as sponge, etc. and washing with the use of a cleansing liquid. Washing with the use of a cleansing liquid necessitates a waste liquid recovering system at a site of washing in order to recover a waste liquid.

It is required that the micro fluid device (109, 215) be constructed to achieve uniform mixing only through passage therethrough of respective materials that constitute a finished product. Different liquids mix uniformly with one another due to diffusion caused by concentration differences in components that constitute respective liquids. Since time required for such diffusion is in proportion to the square of diffusion distances of respective components, it is essential to have respective liquids meeting with one another in diffusion distances as small as possible and mixing with one another within time as short as possible. For example, in the case where two kinds of liquids are to mix with each other in a container having a dimension of 1 cm, liquids disposed in the farthest positions must move a distance of 1 cm in order to mix with each other. In contrast, when the liquids are mixed with each other in a container having a dimension of around 0.1 mm, travel will amount to 0.1 mm, so that time one ten-thousandth of time for a container that has a dimension of 1 cm is enough for mixing. Therefore, uniform mixing is enabled in a short time, in which two kinds of liquids is caused to flow in a container, without agitating and mixing the liquids in the container, and so mixing of many kinds of liquids can be realized by the flow treatment.

Figure 3:
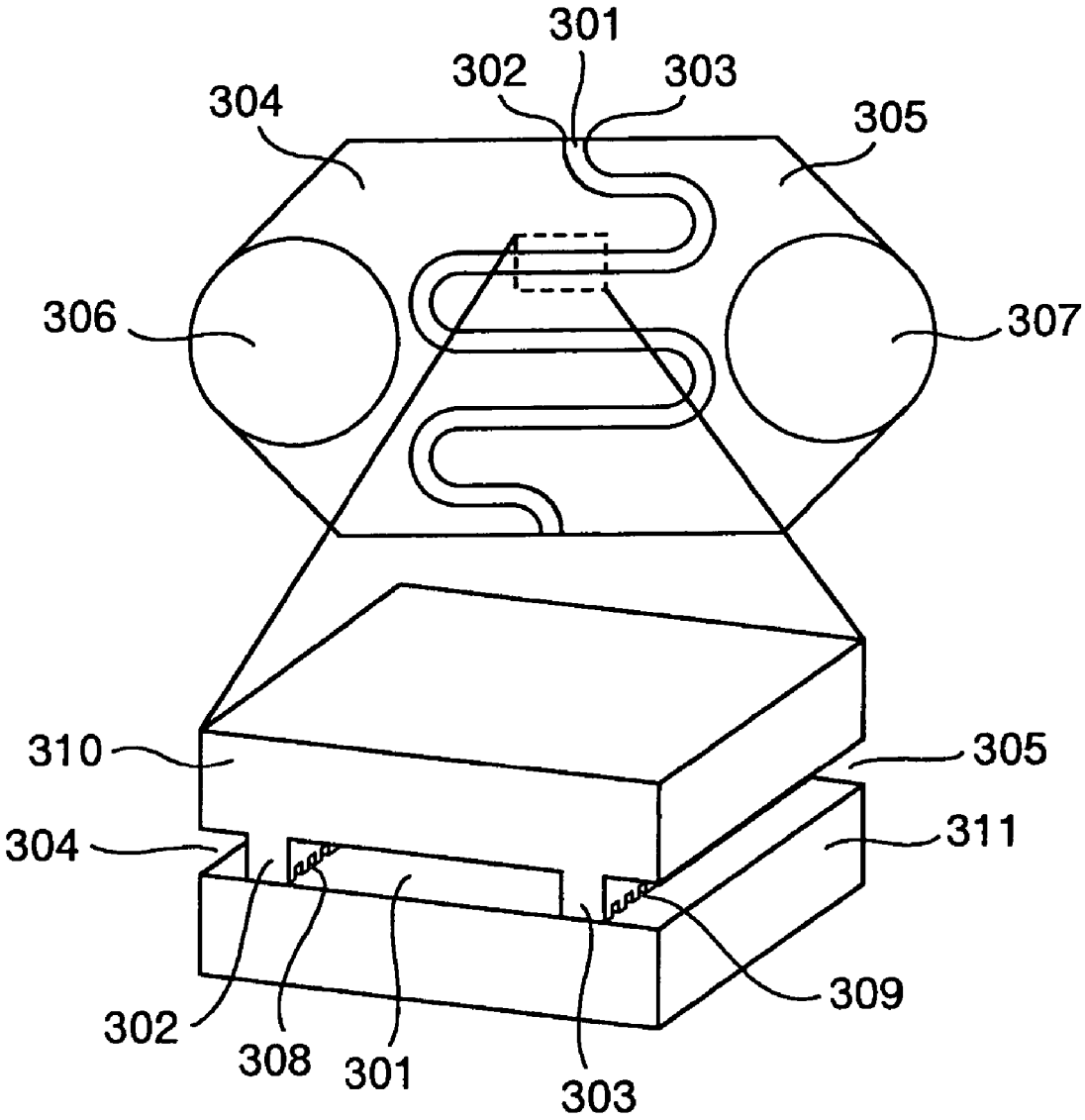
FIG. 3 is a view showing an outline of a first embodiment of a micro fluid device according to the invention.

FIG. 3 shows a first embodiment of a micro fluid device 109, 215 that realizes such mixing.

For example, a micro fluid device is configured such that a groove is worked on a first substrate, a second substrate is joined or closely adhered to the first substrate to cover the groove to form a mixing flow passage, at least one space is separated from the mixing flow passage, a plurality of through-holes communicating the mixing flow passage with the at least one space are formed on at least one surface of the first substrate defining the mixing flow passage so as to extend along a flow direction in the mixing flow passage, and another kind of fluid is discharged into a fluid that flows in the mixing flow passage, thereby forming layered flows, in which the fluid flowing in the mixing flow passage and the fluid discharged from the through-holes alternately flow, and to be mixed with one another in the mixing flow passage.

For example, a micro fluid device comprises a zigzag type mixing flow passage 301 for mixing of a plurality of liquids, buffers 304, 305 filled with liquids that are to be mixed in the mixing flow passage, inlets 306, 307, through which the liquids enter the respective buffers 304, 305, partitions 302, 303 that separate the mixing flow passage 301 and the buffers 304, 305 from each other, and minute nozzle groups 308, 309 are provided on surfaces of the partitions 302, 303 to be aligned in a flow direction of the liquid flowing in the mixing flow passage and to communicate the mixing flow passage 301 with the buffers 304, 305 to each other. Liquids are discharged from the minute nozzle groups 308, 309 into the liquid flowing in the mixing flow passage 301, whereby all liquids are mixed together.

Figure 4A:
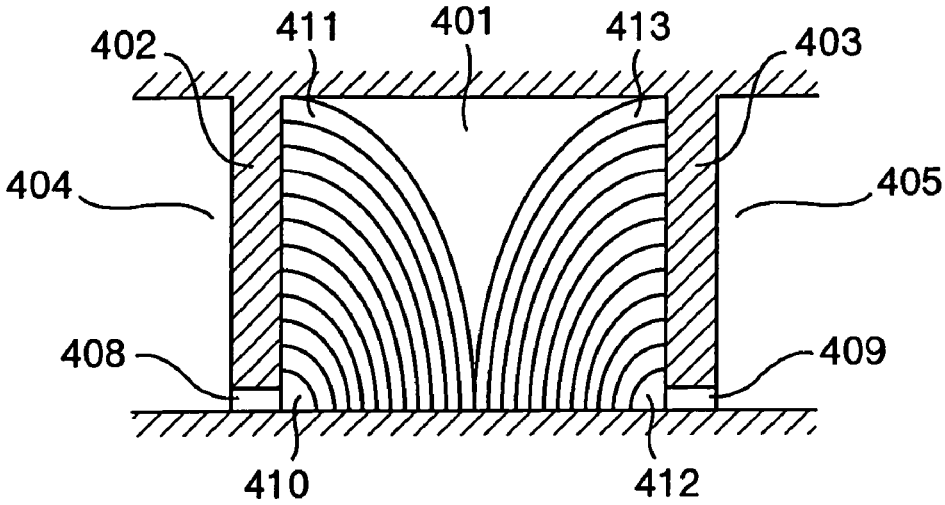
Figure 4B:
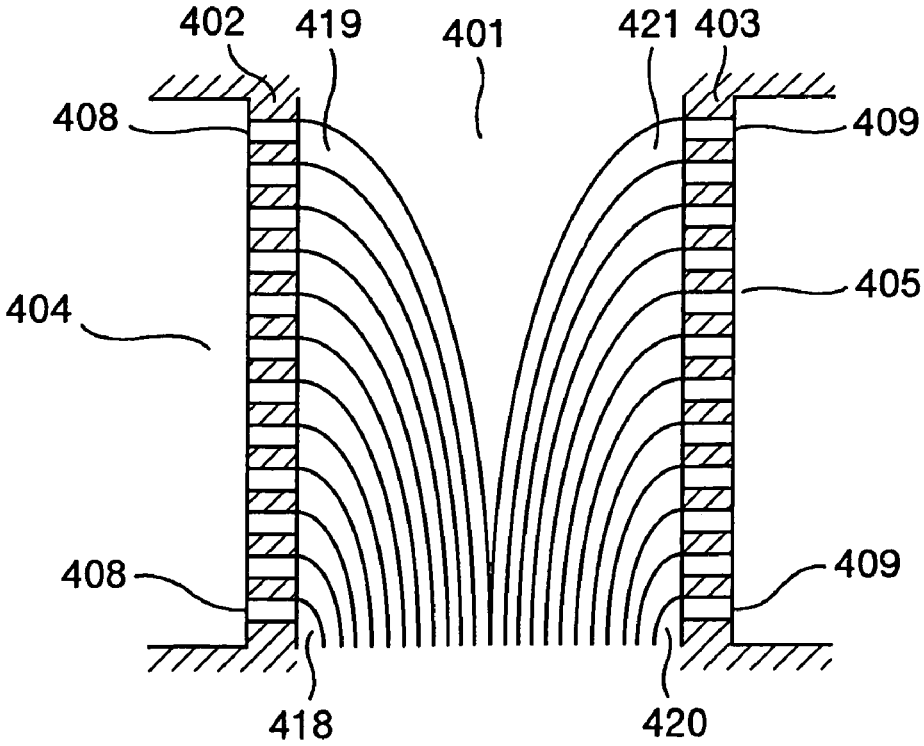

A state of mixing will be described with reference to FIGS. 4A and 4B. FIG. 4A is a vertical cross sectional view showing the vicinity of a mixing flow passage, which includes a mixing flow passage 401, buffers 404, 405, partition walls 402, 403, and micro nozzle groups 408, 409 for communicating the mixing flow passage 401 with the buffers 404, 405. FIG. 4B is a horizontal sectional view showing the vicinity of the mixing flow passage.

First, for a first material liquid flowing in the mixing flow passage 401 from an upper location to a lower location in FIG. 4B, a second material liquid filled in the buffer 404 is discharged into the mixing flow passage 401 via the micro nozzles 408 extended through the partition 402 and a third material liquid filled in the buffer 405 is discharged into the mixing flow passage 401 via the micro nozzles 409 extended through the partition 403. At this time, the second material liquid (418) discharged via the micro nozzle 408 disposed downstream of the flow direction is carried away in an upstream-to-downstream direction of the mixing flow passage 401 by a flow directed in the same direction in the mixing passage 401. The second material liquid (419) discharged via the micro nozzles 408 disposed upstream of the flow direction flows so as to envelope the second material liquid discharged via the micro nozzles 408 disposed downstream, thus forming an overlapping laminar flow, an outermost layer of which is formed by the second material liquid (419) discharged via the micro nozzle 408 disposed most upstream. At this time, the first material liquid flowing in the mixing flow passage 401 enters between the second material liquid discharged via the respective micro nozzles 408, so that a laminar flow composed of the first material liquid and the second material liquid is formed. Likewise, a laminar flow composed of the first material and the third material is formed.

In a vertical direction of the mixing flow passage 401, the second material liquid (410–411) and the third material liquid (412–413) discharged into the mixing flow passage 401 also combine with the first material liquid to form a laminar flow in the vertical direction.

For example, in the case where the mixing flow passage 401 has a cross sectional shape of 200 μm and the micro nozzle groups 408, 409 are sized to be 40 μm square and aligned 50 in number at a pitch of 80 μm along the mixing flow passage 401, the second and third material liquids discharged through the fifty nozzles are aligned in the first material liquid having flowed through the mixing flow passage to become laminar therein. Since 50 rows are present in a width of 200 μm, the rows are aligned at a pitch of 4 μm and the first material liquid having flowed through the mixing flow passage is present between the rows, so that a maximum distance of movement required for diffusion amounts to 2 μm. When calculation is performed by the use of a diffusion coefficient of $0.72\times10^{-5}$ [cm2/s] in the case where glycerin diffuses in pure water, a period of time required for diffusion is a little under 0.01 sec.

As described above, by shortening a diffusion length from the outset when three kinds of stock liquids are mixed together as in the micro fluid device of the first embodiment, mixing is realized in a short time without performing agitation. In addition, mixing of more materials with the use of such micro fluid device can be realized by aligning a plurality of buffers along a flow direction in the mixing flow passage 301. In the case where the micro flow passages described above are used to treat a liquid of several tens mL every minute, there is a problem that pressure loss places a limit on a quantity of a liquid as fed. Therefore, in the case where such micro flow passages are used to feed a liquid or liquids, there is a need of adopting one of measures of providing a feed transfer system and a sealing mechanism of joints, which are capable of bearing pressure loss, enlarging a cross sectional area of the mixing flow passage 401 to increase the number of the micro nozzles group 408, 409 disposed in the partitions 402, 403 to increase the number of layers of liquids being mixed to thereby shorten a diffusion length, and reducing a quantity being treated in a single chip to ensure a quantity of treatment in parallel treatment of chips. In the case where a quantity of treatment in parallel treatment should be ensured, how mixing ratios in the respective mixing flow passages are made equal to one another presents a problem, for which a laminated type chip requires some consideration to equalize pressure loss in the respective mixing flow passages and the respective liquid transfer systems leading to the micro nozzle groups. Further, machining accuracy is demanded of the respective mixing flow passages and the micro nozzle groups.

Therefore, application of the fine processing making use of the micromachining technique, to which the processing technique for semiconductors is applied, is optimum as measures for fabrication of micro fluid devices. As an example, there is a processing method based on the anisotropic etching technique for single crystal silicone, called bulk micromachining. In this case, a micro fluid device is fabricated by forming the mixing flow passage 301, the buffers 304, 305, and the minute nozzle groups 308, 309 on a silicone substrate 310, and using the anode joining technique to cover the mixing flow passage 301, the buffers 304, 305, and the minute nozzle groups 308, 309 with a pyrex glass piece 311. Methods of fabricating an inexpensive disposable device also include a method of molding a structure similar to the silicone substrate 310 from PDMS (silicone elastomer). In this case, a mold for transcribing the structure into PDMS is formed in a first step. The method of forming the mold includes a way to form a mold on the silicone substrate with the use of the bulk micromachining described above, and a forming method making use of thick film resist. In a subsequent step, PDMS is coated on the mold and solidified in cross-linking reaction.

Thickness of PDMS is controlled by a quantity of PDMS coated in a state of restricting a range, in which PDMS spreads. Subsequently, PDMS is separated after completion of solidification and a lid 311 is joined over the mixing flow passage 301, the buffers 304, 305, and the minute nozzle groups 308, 309, which have been transcribed into PDMS. In the joining process, the same PDMS, glass, aluminum, etc. are used for the lid 311 whereby the lid can be joined to the PDMS 310, on which the mixing flow passage 301, the buffers 304, 305, and the minute nozzle groups 308, 309 are formed, only by overlapping junction surfaces together after plasma processing is effected on the junction surfaces.

An embodiment shown in FIG. 3 has a feature in a mixed liquid manufacturing apparatus. The mixed liquid manufacturing apparatus comprises a first substrate 310, and a second substrate 311 that constitutes a lid and defines a first flow passage 301 permitting a first fluid to flow therethrough between it and the first substrate 310, and the first substrate 310 includes a first nozzle region 308 and a second nozzle region 309, from which first and second fluids being mixed with the fluid flowing through the first flow passage 301 are supplied and which are formed to interpose therebetween the first flow passage 301.

Thereby, since the mixing nozzles are formed on a side of the first substrate, a multiplicity of minute nozzles can be easily formed.

The first nozzle region 308 comprises a multiplicity of nozzles 308 arranged in the first partition wall 302 formed on the first substrate 310, in a flow direction in the first flow passage. The first buffer 304 is a supply section of a first fluid being supplied through the first nozzles and arranged with the first partition wall 302 between it and the first flow passage 301.

Likewise, preferably, the second nozzle region 309 comprises a multiplicity of nozzles 309 arranged in the second partition wall 303 formed on the first substrate 310, in a flow direction in the first flow passage. The second buffer 305 is a supply section of a second fluid being supplied through the second nozzles and arranged with the second partition wall 303 between it and the first flow passage 301.

A configuration with the first and second partition walls integrally formed with the first substrate is preferable by virtue of parts being small in number while a configuration may do, in which the first substrate and the first and second partition walls are formed from separate members and fixed together.

The nozzles formed in the first nozzle region and the second nozzle region form flow passages for the first fluid and the second fluid between the first substrate and the second substrate.

It is preferable that a height of the first flow passage 301 be five or more times that of the nozzles 308 or 309 in a direction, in which the first substrate 310 and the second substrate 311 are stacked.

Formation in this manner is preferable with a view to reducing pressure loss as a whole. For example, it is thought that 100 or less times is practical in order to make a whole size small. In addition, 100 or more times will do in terms of construction or other conditions.

It is preferable with a view to achieving an efficient mixing that a number of the nozzles 308 constituting the first nozzle region be more than a ratio of a height of the first flow passage 301 to a height of the first nozzles 308 in a direction, in which the first substrate 310 and the second substrate 311 are stacked. With a view to miniaturization as a whole, it is thought that 100 or less times is practical. In addition, 100 or more times will do in terms of construction or other conditions.

The micro fluid device can also be realized having a size that affords formation without the use of the micromachining technique. In such micro fluid device, the mixing function equivalent to that of the first embodiment is given in a nozzle size and a nozzle pitch, which are possible in machining, by reduction in diffusion length that is achieved by aligning a plurality of liquids desired to be mixed, in a stripe manner and narrowing stripe flows in width.

For example, a mixing flow passage formed on a substrate is sheet-shaped. Nozzles comprising through-holes that are communicated with one space separated from the mixing flow passage are formed on a bottom surface of the mixing flow passage so as to align in a row in perpendicular to a flow direction of the mixing flow passage. The group of nozzles permit a kind of another material liquid to be discharged to a material liquid flowing through the mixing flow passage. Thus, a laminar flow is formed, in which the material liquid flowing through the mixing flow passage and another material liquid discharged from the through-holes alternately flow.

In the case where a plurality of material liquids are to be mixed, rows of the nozzle groups corresponding to kinds of material liquids being desired to be mixed are formed in parallel to each other and in perpendicular to the flow in the mixing flow passage. The respective nozzles are in the same positions as those of the nozzles in a subsequent row in the flow direction in the mixing flow passage. With this structure, the material liquids discharged from the respective nozzles flow in a manner to shroud a material liquid discharged from a subsequent nozzle to thereby form a laminar flow. A cross sectional area of the mixing flow passage, through which the thus formed laminar flows of the plurality of material liquids flow, is decreased to reduce spacings between the laminar flows, so that mixing of the plurality of material liquids is completed and the mixed liquid is then discharged from the micro fluid device.

Figure 5A:
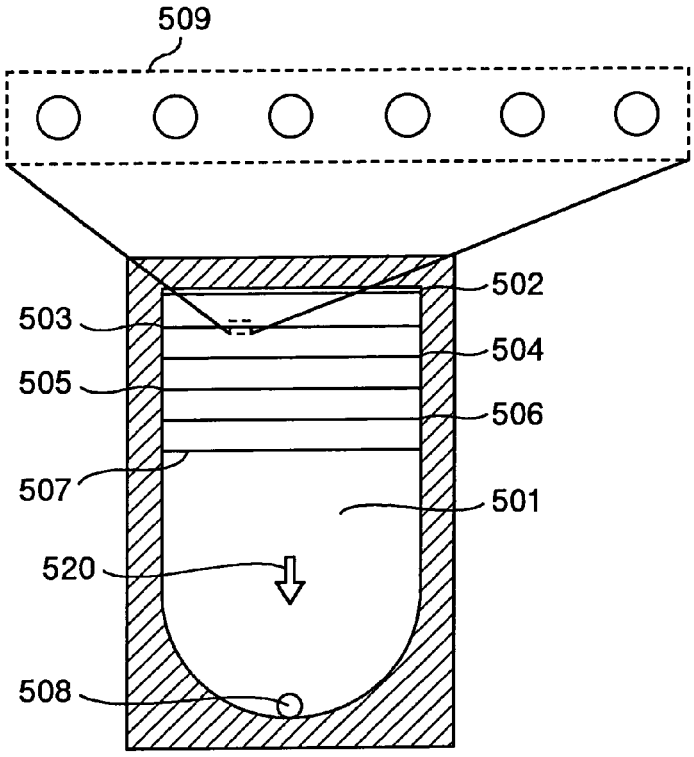
Figure 5B:
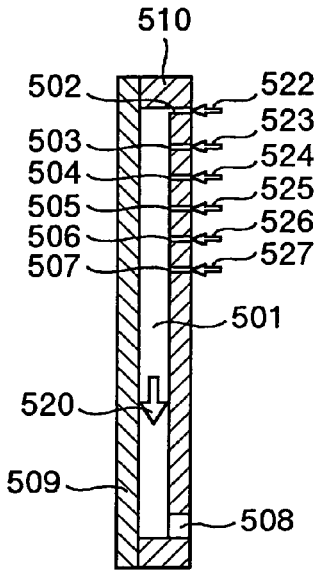

FIGS. 5A and 5B show the second embodiment of the micro fluid device having the above-described structure. FIG. 5A is a horizontal sectional view and FIG. 5B is a vertical sectional view. The micro fluid device comprises a substrate 510, on which a sheet-shaped groove 501, slit-shaped nozzles 502, and groups 503–507 of minute nozzles are formed, and a lid 509. The groups 503–507 of minute nozzles comprise minute nozzles 509. In the micro fluid device, a liquid flows (520) from above to below in the drawings, a first material liquid is discharged as indicated by an arrow 522 from the slit-shaped nozzles 502 to flow downward in the sheet-shaped flow passages 501, and five kinds of a second to a sixth material liquid are respectively discharged as indicated by arrows 523–527 from the groups 503–507 of minute nozzles to flow downward in the sheet-shaped flow passages 501. At this time, the minute nozzles 509 in the groups 503–507 are formed in positions on the same line of flow in the flow direction, so that a laminar flow illustrated in FIGS. 3 and 4 is formed. The micro fluid device is designed such that the laminar flow is throttled at an outlet 508 disposed at a distal end of the sheet-shaped flow passage 501 in the flow direction, distances between layers are narrowed, and mixing is enabled only by diffusion in a short time.

However, since the respective material liquids define a single layer in a depthwise direction, mixing is realized in the case where the second material liquid to the sixth material liquid discharged from the respective groups 503–507 of minute nozzles are much in flow rate and are adequately spread in a depthwise direction of the sheet-shaped flow passages 501 to be discharged. When the material liquids discharged from the respective groups 503–507 of minute nozzles are small in quantity, there is a possibility that they are not adequately spread in the depthwise direction but flow only in a bottom of the sheet-shaped flow passage 501, and so adequate diffusion in the depthwise direction is not achieved, and so there is a possibility that adequate mixing cannot be achieved even when the flow is throttled finally at the outlet 508 and distances between layers are narrowed.

A micro fluid device shown in FIGS. 6A, 6B and 6C serves as measures to solve such problem. Streamlined enclosures having the same height as a thickness of the sheet-shaped flow passages and having openings in the flow direction are formed around individual nozzles of a group of nozzles comprising through-holes that are formed on a surface of a substrate to be communicated with spaces separated from the mixing flow passage and formed in perpendicular to the flow direction, whereby flows of material liquids discharged in the mixing flow passage from the nozzles can be distributed in the depthwise direction of the sheet-shaped flow passage without being affected and form a laminar flow in parallel in the thicknesswise direction.

The device has a feature in that the second to sixth material liquids discharged from respective nozzles 609 of groups 603–607 of minute nozzles are protected by streamlined protective walls 610 from flow from an upstream side of the groups of minute nozzles and the second to sixth material liquids spread in a thicknesswise direction of the flow to realize a laminar flow in a widthwise direction of the flow. Thereby, even when minute material liquids are discharged from the groups 603–607 of minute nozzles, the liquid spreads in the thicknesswise direction of the flow to maintain a laminar flow, so that diffusion length can be surely shortened by throttling the flow at an outlet 608 and uniform mixing can be stably performed in a short time.

The micro fluid devices shown in FIGS. 5 and 6 have a feature as a mixed liquid manufacturing apparatus. They comprise a first substrate 510 and a second substrate 509 forming a lid. The substrates 509, 510 constitute a first flow passage 501 of a sheet-shape to permit a first fluid to flow therethrough. The first substrate 510 comprises a first nozzle region (for example, 503), in which a plurality of first nozzles for supplying a first mixed fluid being mixed with a fluid that flows through the first flow passage 501 are arranged at intervals in a direction transverse to the flow of the fluid, and a second nozzle region (for example, 504), which is disposed on a downstream side of the first flow passage in the first nozzle region, and in which a plurality of second nozzles for supplying a second mixed fluid being mixed with the fluid that flows through the first flow passage are arranged at intervals in the direction transverse to the flow of the fluid. The second nozzles are arranged in a region, through which the first mixed fluid supplied by the first nozzles flows, among a region, through which the first fluid flows. The above feature will be concretely described below with reference to FIG. 7.

In addition, it is preferable that the first mixed fluid supplied from the plurality of nozzles flow at intervals in the direction transverse to the flow of the first fluid when flowing at the second nozzle region.

A further feature resides in the provision of the protective walls 610 disposed in the first flow passages on an upstream side of the first nozzles to correspond to the first nozzles.

The walls may comprise walls that connect between the first substrate and the second substrate. Also, the walls can comprise projections that project toward the second substrate from the first substrate, on which the nozzles are formed.

Figure 7:
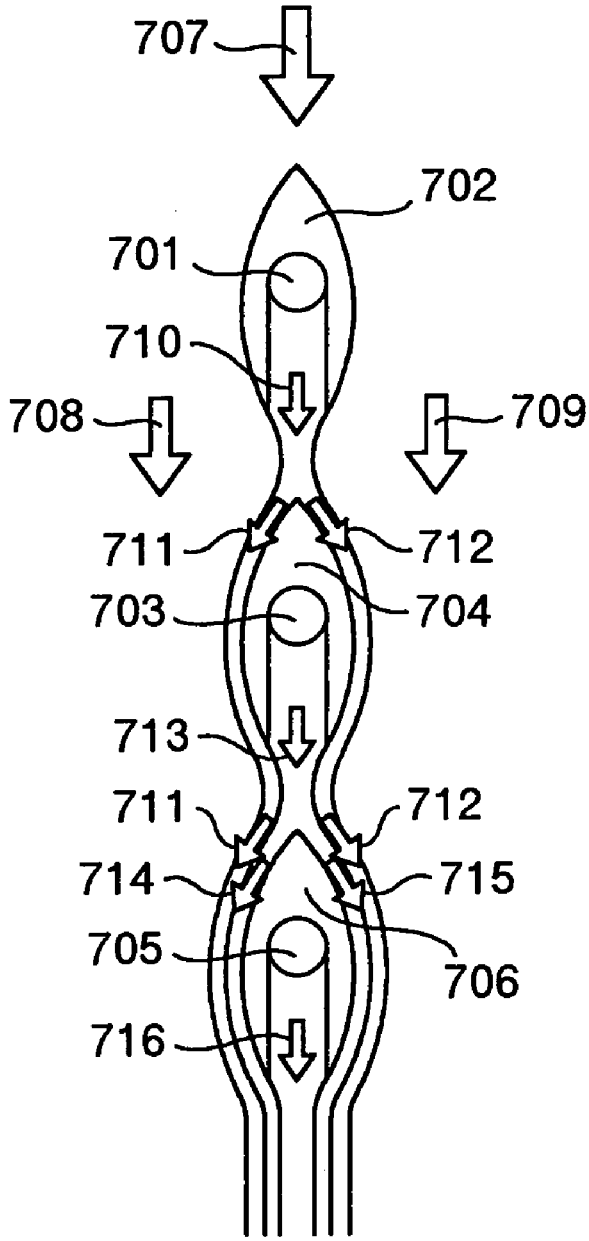
FIG. 7 is a view illustrating a flow state in the micro fluid device shown in FIGS. 6A, 6B and 6C.

FIG. 7 shows a flowing state in the sheet-shaped flow passage 601. Since respective minute nozzles 701, 703, 705 of the respective nozzle groups 603, 604, 605 are arranged on a streamline of the flow through the sheet-shaped flow passage 601, flow 707 of the first material liquid is divided into two flows 708, 709 by a protective wall 702 of a first discharge nozzle 701, between which flow 710 of the second material liquid is interposed. Further, the flow 710 of the second material liquid between the flows 708, 709 of the first material liquid is divided into two flows 711, 712 by a protective wall 704 of a second discharge nozzle 703, between which flow 713 of the third material liquid interposed. The flow 713 of the third material liquid between the flows 708, 709 of the first material liquid and the flows 711, 712 of the second material liquid is similarly divided into two flows 714, 715 around a third discharge nozzle 705, between which flow 716 of the fourth material liquid is interposed. In this manner, since the respective nozzles are arranged on the same streamline, the respective flows can be divided into two flows, so that laminar flows, the number of which is twice the number of nozzles, can be formed and of which diffusion length can be reduced to half (diffusion time amounts to one fourth). In the case where measures of such sheet-shaped mixing flow passage is adopted, it is possible to obtain a cross sectional area on different scales relative to a cross sectional area of the meandering flow passage type mixing flow passage shown in FIG. 3 and to perform the treatment at the rate of several tens mL/min with the use of a single micro fluid device, so that simplification of the device and the system can be achieved because any parallel treatment is not necessary. In addition, not only machining but also the micromachining technique can be of course applied in working of the micro fluid device.

Since the micro fluid device 109, 215 fabricates a final product in the flow treatment, a most simple method is to mount the dispensing nozzle 110, 217, through which a final product is discharged into a sales container, on the dispensing nozzle 110, 217 and to dispense the final product as it is. Accordingly, a nozzle for dispensing may be formed integral with the micro fluid device, or a detachable nozzle may be mounted on the micro fluid device. However, there is caused a problem that when a nozzle portion becomes dirty, a final product adheres to the nozzle portion to be curvedly discharged when a final product is discharged, and the final product remains in the nozzle to be mixed in a next product. Therefore, it is required that a nozzle be disposable to be replaced by a new one each time, or the function of cleaning a dispensing nozzle be provided for. Further, it is necessary to prevent various bacteria and dust from entering into a sales container 111, 218 when a final product is dispensed into the sales container 111, 218 and to make the sales container a clean space, which is closed and cut off from an interior of a store until dispensing is terminated and the sales container is capped. Accordingly, dust is removed through a filter from an air in the space, and a sterilizing lamp is used to maintain a sterilized state while an ultraviolet-ray cutting-off door is closed.

A work to print a component structure of the final product, which is received in a sales container 111, 218, and a name designated by a customer on a label with a pattern conformed to the customer's taste and to stick the label to the sales container is performed in parallel within a time for preparation of the final product described above. While the customer decides a design of a label being stuck to the product and a name, the final product is passed through the micro fluid device 109, 215 to be received in the sales container 111, 218, and immediately after the customer finishes decision of a design for a label and a name, the customer can receive the sales container appearing from the on-demand manufacture apparatus, in which sales container the final product is received, and to which sales container a label having printed thereon a pattern selected by the customer and a name designated by the customer is stuck.

As described above, when the present apparatus is used, it suffices that only a necessary minimum region be maintained in an environment required for manufacture of a product and mixing is enabled only by passing a liquid through the micro fluid device, so that any agitating operation is unnecessary, the running cost can be restricted to low, and a customer can quickly obtain cosmetic adapted thereto on the spot. Further, since the micro fluid device is used to be able to fabricate a sample of a smaller amount than that of a sales product and with the same quality as that of the sales product, it is also possible to actually fabricate a product after the sample is estimated by a customer. Concretely, a system that can obtain a high customer's satisfaction can be constructed by preparing a micro container, from which a sample is taken, or absorbent cotton being loaded with a sample and having a customer trying the sample to determine whether the customer buys the product.

While the on-demand manufacture/selling system for cosmetic has been described hereinbefore, it can also be applied to chemical compounding systems, chemical analysis systems, etc. by adding to the system a temperature control mechanism for the micro fluid device, an absorptiometer, etc.

Figure 8:
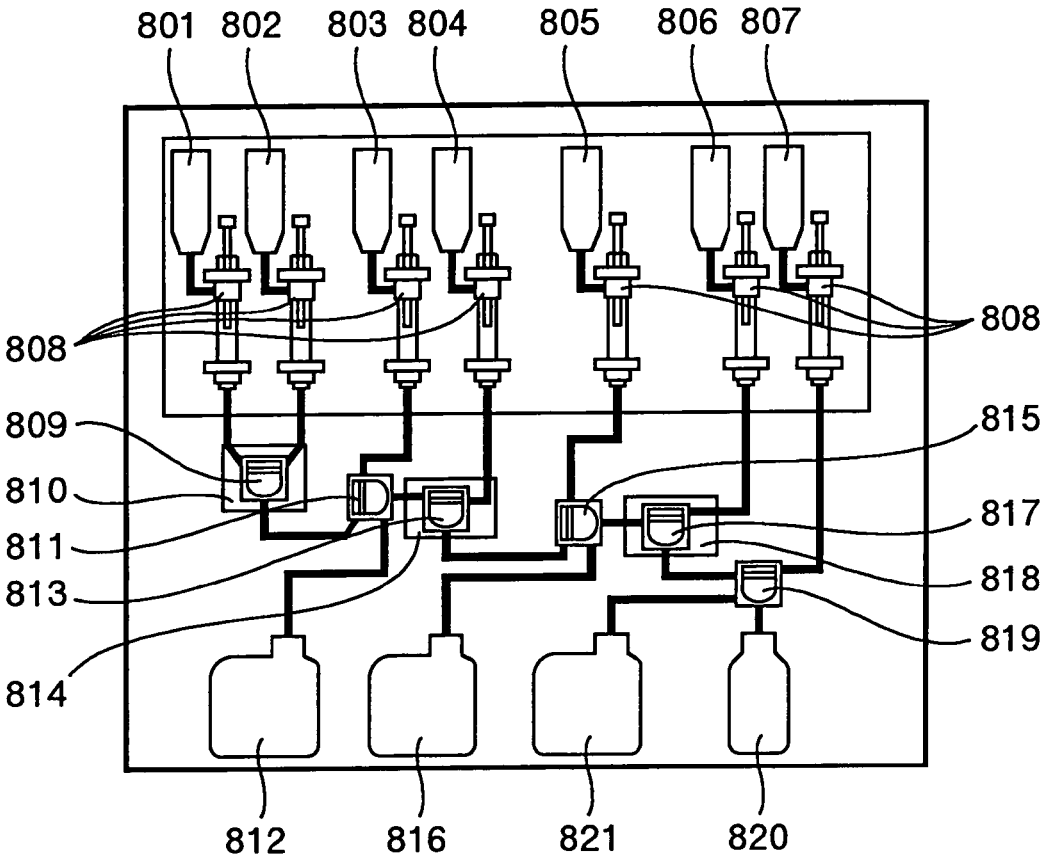
FIG. 8 is a view showing an outline of another embodiment of a mixed liquid manufacturing apparatus according to the invention.

FIG. 8 shows a further example of a mixed liquid manufacturing apparatus. This corresponds to an on-demand chemical compounding system. Multi-stage chemical compounding is performed by using four kinds of reagents 801, 802, 804, 806 and three kinds of extracts 803, 805, 807. The system has a feature in that since the multi-stage compounding is performed in the flow treatment, all the reagents and all the extracts are fed in flow rates corresponding to respective quantities for use and at the same timing. A reagent I 801 and a reagent II 802 are fed in appropriate quantities to a micro reaction device I 809 by liquid pumps to perform chemical reaction in the device. At this time, the micro reaction device I 809 is kept at an optimum temperature for the reaction by a thermoregulator I 810. A product generated by the reaction is fed to a micro extraction device I 811 to be brought into contact with an extract I 803 within the micro extraction device I 811 to be divided into necessary ingredients and unnecessary ingredients. The necessary ingredients are fed to a next micro reaction device II 813 and the unnecessary ingredients are fed to a waste liquid tank I 812. The ingredients fed to the micro reaction device II 813 are mixed there with a reagent III 804, and chemical reaction proceeds in a state, in which the ingredients are maintained at an optimum temperature by a thermoregulator II 814. The resulting product is fed to a micro extraction device II 815. The product fed to the micro extraction device II 815 is brought into contact there with an extract II 805. Necessary ingredients are fed to a next micro reaction device III 817 and unnecessary ingredients are fed to a waste liquid tank II 816 in the same manner as that described above. After the ingredients react with a reagent IV 806 in a micro reaction device III 817, they are brought into contact with an extract III 807 by a micro reaction device III 817, whereby unnecessary ingredients are removed to be fed a waste liquid tank III 821 and only a target product is discharged to a product container 820. Since this series of processes occur in flow passages in succession and the parallel treatment is performed, any dead time as in a batch treatment is not generated between respective processes and the system is easy of automation without labor.

FIG. 8 shows the embodiment, in which respective processes are carried out in different micro fluid devices (micro reaction devices), but the processes can be assembled into a single micro fluid device. In the case where the micro fluid device illustrated with reference to FIG. 3 is used to carry out respective processes, the multi-stage compounding process in the flow treatment can be carried out by arranging buffers for respective reagents that are mixed in multi-stage processes in a flow direction in the meandering mixing flow passage 301, in series, determining spacings of the buffers, in which the respective reagents are received, according to residence time required for reaction in the mixing flow passage, and forming a next buffer in a distant position in the case of reactions involving long residence time. At this time, in the case where optimum temperatures in the respective compounding processes are different from one another, the mixing flow passages between the respective buffers are controlled to optimum temperatures for the reactions. Since it becomes difficult to differentiate the respective mixing flow passages in temperature from one another when the micro fluid devices are made of a material, such as silicone, etc. having a good thermal conductivity, however, it is preferable that respective reactions in the multi-stage compounding process be carried out in separate micro fluid devices and a series reaction system be formed by using a resin having a small thermal conductivity to connect between inlets and outlets of the respective micro fluid devices. Further, in the case where there is a need for such processes as separation, extraction, concentration, etc. of products fabricated in the multi-stage compounding process, the flow treatment is performed by incorporating respective function devices connected in series to the micro fluid devices of the present system. In this case, there is also a need for pumps that feed extracts, etc. used in the respective function devices.

In this manner, while the systems provided with the mixing units shown in FIGS. 3, 5, and 6 preferably constitute on-demand cosmetic systems for cosmetic liquid, perfume, etc. and on-demand chemical compounding systems as illustrated above, they can constitute other compound manufacturing apparatuses than the above described systems.

It should be further understood by those skilled in the art that although the foregoing description has been made on embodiments of the invention, the invention is not limited thereto and various changes and modifications may be made without departing from the spirit of the invention and the scope of the appended claims.

What is claimed is:

1. A mixed liquid manufacturing apparatus comprising:

an information input unit, in which customer information is input;

a material storage system that stores a plurality of materials for a mixed liquid;

a product information system that selects kinds and quantities of the stored materials on the basis of the input customer information;

a liquid transfer unit, by which the selected materials are taken out from the material storage system;

a mixing unit, in which the materials supplied from the liquid transfer unit are mixed;

an injection unit, by which the mixed liquid is injected into a mixed liquid container;

an input unit, by which matters being declared on a label of the mixed liquid container are input; and a label formation unit, in which the input matters are printed on the label and the label is stuck on the mixed liquid container, and wherein the mixing unit comprises a first substrate and a second substrate that define a flow passage, through which a fluid flows, and the first substrate comprises a first nozzle region and a second nozzle region, from which a first and a second fluid being mixed with the fluid flowing through the flow passage are supplied, and the first nozzle region and the second nozzle region are arranged to interpose therebetween the flow passage.

2. A mixed liquid manufacturing apparatus comprising:

an information input unit, in which customer information is input;

a material storage system that stores a plurality of materials for a mixed liquid;

a product information system that selects kinds and quantities of the stored materials on the basis of the input customer information;

a liquid transfer unit, by which the selected materials are taken out from the material storage system;

a mixing unit, in which the materials supplied from the liquid transfer unit are mixed;

an injection unit, by which the mixed liquid is injected into a mixed liquid container;

an input unit, by which matters being declared on a label of the mixed liquid container are input; and a label formation unit, in which the input matters are printed on the label and the label is stuck on the mixed liquid container, and wherein the mixing unit comprises a first substrate and a second substrate that define therebetween a flow passage, through which a fluid flows, the first substrate comprises a first nozzle region, in which a plurality of first nozzles for supplying a first fluid being mixed with the fluid flowing through the flow passage are arranged at intervals in a direction transverse to the flow of the fluid flowing through the flow passage, and a second nozzle region, which is disposed on a downstream side of the first nozzle region in the flow passage, and in which a plurality of second nozzles for supplying a second fluid being mixed with the fluid flowing through the flow passage are arranged at intervals in the direction transverse to the flow of the fluid flowing through the flow passage, the second nozzles are arranged in a region, through which the first fluid supplied by the first nozzles flows, in a region, through which the fluid flows.

3. The mixed liquid manufacturing apparatus according to claim 1, wherein the mixed fluid comprises perfume or cosmetic liquid.

4. The mixed liquid manufacturing apparatus according to claim 2, wherein the mixed fluid comprises perfume or cosmetic liquid.

5. A mixed liquid manufacturing apparatus comprising a first substrate and a second substrate that define therebetween a flow passage, through which a fluid flows, and the first substrate comprises a first nozzle region, from which a first fluid being mixed with the fluid flowing through the flow passage, is supplied, and a second nozzle region, from which a second fluid being mixed with the fluid flowing through the flow passage, is supplied, and the first nozzle region and the second nozzle region are arranged to interpose therebetween the flow passage.

6. The mixed liquid manufacturing apparatus according to claim 5, wherein the first nozzle region includes a multiplicity of first nozzles arranged on a first wall, which is formed on the first substrate, along a flow direction in the flow passage, and a supply unit for the first fluid being supplied to the first nozzles is formed to be positioned relative to the flow passage with the first wall therebetween.

7. The mixed liquid manufacturing apparatus according to claim 5, wherein the nozzles formed in the first nozzle region and the second nozzle region form flow passages for the first fluid and the second fluid between the first substrate and the second substrate.

8. A mixed liquid manufacturing apparatus comprising a first substrate and a second substrate that define therebetween a flow passage, through which a fluid flows, and the first substrate includes a first nozzle region, in which a plurality of first nozzles for supplying a first fluid being mixed with the fluid flowing through the flow passage are arranged at intervals in a direction transverse to the flow of the fluid, and a second nozzle region, which is disposed on a downstream side of the first nozzle region in the flow passage, and in which a plurality of second nozzles for supplying a second fluid being mixed with the fluid flowing through the flow passage are arranged at intervals in the direction transverse to the flow of the fluid, and the second nozzles are arranged in a region, through which the first fluid supplied by the first nozzles flows, in a region, through which the fluid flows.

9. The mixed liquid manufacturing apparatus according to claim 8, further comprising wall portions disposed in a region that includes a side of the flow passage upstream of the first nozzles and in positions respectively corresponding to the first nozzles.

10. The mixed liquid manufacturing apparatus according to claim 5, wherein the first fluid supplied from the first nozzle region is larger in flow rate than that of the second fluid that is supplied from the second nozzle region and is smaller in dispensing quantity than the first fluid.

11. The mixed liquid manufacturing apparatus according to claim 8, wherein the first fluid supplied from the first nozzle region is larger in flow rate than that of the second fluid that is supplied from the second nozzle region and is smaller in dispensing quantity than the first fluid.

* * * * *